US007288732B2

(12) United States Patent
Hashida

(10) Patent No.: US 7,288,732 B2
(45) Date of Patent: Oct. 30, 2007

(54) MULTIDIRECTIONAL INPUT DEVICE

(75) Inventor: Junji Hashida, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/479,752

(22) Filed: Jun. 30, 2006

(65) Prior Publication Data

US 2007/0007112 A1 Jan. 11, 2007

(30) Foreign Application Priority Data

Jul. 6, 2005 (JP) ..... 2005-197875
Jul. 6, 2005 (JP) ..... 2005-202854

(51) Int. Cl.
*H01H 9/26* (2006.01)
*H01H 13/72* (2006.01)
*H01H 13/76* (2006.01)

(52) U.S. Cl. ..... 200/5 A; 200/6 A

(58) Field of Classification Search ..... 200/5 A
See application file for complete search history.

(56) References Cited

U.S. PATENT DOCUMENTS 3,673,357 A * 6/1972 Molchan ..... 200/5 A
3,996,427 A * 12/1976 Kaminski ..... 200/5 A
4,005,293 A * 1/1977 Boulanger ..... 200/5 A
4,170,104 A * 10/1979 Yamagata ..... 368/289
5,399,823 A * 3/1995 McCusker ..... 200/521

FOREIGN PATENT DOCUMENTS

JP 2001-345031 12/2001

* cited by examiner

*Primary Examiner*—Elvin Enad
*Assistant Examiner*—Lheiren Mae A. Anglo
(74) *Attorney, Agent, or Firm*—Brinks Hofer Gilson & Lione

(57) ABSTRACT

A multidirectional input device is provided. A multidirectional input device includes a keytop capable of moving up and down through pressing. A membrane switch that has a plurality of switch elements and is arranged on the side that faces the reverse side of said key top. A plurality of domed switch operating assembly arranged above said plurality of switch elements are capable of switching on said switching elements. The plurality of switch operating assemblies are connected with strip-shaped joint portions to be integrated. Upon pressing the key top, at least one of said plurality of switch operating assemblies is pressed, and thereby at least one of said plurality of switch elements can be switched on.

13 Claims, 5 Drawing Sheets

MULTIDIRECTIONAL INPUT DEVICE

This application claims the benefit of Japanese Patent Application No. 2005-202854 filed in Japan on Jul. 6, 2005, hereby incorporated by reference.

BACKGROUND

1. Field

A multidirectional input device is provided.

2. Related Art

In the conventional multidirectional input device 100, as shown in FIG. 9, the circular keytop 170 is press-fitted to the push slide 150 to be fixed in the external housing 180. A rotary plate 132 and a chassis 121 are fixed to the push slide 150, and these are placed on the switch substrate 110 on which the domed push switches 110*b*, 110*c*, 110*d*, 110*e* and 110*f* are allocated.

The vicinity of the circumference of the keytop 170 is pressed in the direction of the arrow A by a first operation. Upon pressing the keytop 170 in the direction of the arrow A, the keytop 170 is tilted in the direction A.

During this tilting operation, the push slide 150, the rotary plate 132 and chassis 121 are simultaneously tilted.

When the chassis 121 is tilted, a convex portion 121*h* of the cassis 121 controls (presses) the push switch 110*b* of the switch substrate 110 with a predetermined control force, whereby the push switch 110*b* is switched on.

When the pressing in the direction of the arrow A is relieved, the tilt of the push slide 150, rotary plate 132, chassis 121 and keytop 170 is restored to the original position due to the elastic force of the push switch 110*b*, and the push switch 110*b* is thereby switched off. With this tilting operation, when another vicinity of the circumference of the keytop 170 is pressed, the keytop 170 is also tilted in the corresponding direction. During this tilt, respective convex portions 121*h* of the chassis 121 switch on the respective push switches 110*c*, 110*d* and 110*e*.

A second operation of the rotary encoder that has a five-directional push switch is to press the center portion of the keytop 170 in the direction of the arrow B as shown in FIG. 10. By pressing the keytop 170 in the direction of the arrow B as described above, the push slide 150 is moved down against the elastic force of the slide return spring 140.

During this descendent of the push slide 150, the convex portion 150*d* of the push slide 150 presses the push switch 110*f* of the switch substrate 110, thereby switching on the push switch 110*f*.

When the pressing on the keytop 170 is relieved, the keytop 170 is automatically returned to the original position due to the elastic recovery force of the push switch 110*f* and the elastic force of the return spring 140.

With the first and second operations described above, the control force of respective push switches 110*c*, 110*d*, 110*e* and 110*f*, and the control force of the slide return spring 140 can be set uniformly or non-uniformly.

Japanese Patent Laid-Open Publication No. 2001-345031 (Patent Document 1) is an example of the related art.

The conventional multidirectional input device 100 described above has a construction such that the keytop 170 presses the domed push switches 110*b*, 110*c*, 110*d*, 110*e* and 110*f* via the push slide 150, rotary plate 132 and chassis 121. A large number of components are needed, and thus, the operational feeling is sacrificed. Since a large number of components are used the size tends to increase in the thickness direction.

SUMMARY

A multidirectional input device is provided.

A multidirectional input device according to the present invention includes a keytop that is capable of moving up and down through pressing. A membrane switch has a plurality of switch elements arranged on the side that faces the reverse side of said key top. A plurality of domed switches operates the assembly described above.

The plurality of switch elements is capable of switching the switching elements. The plurality of switch operating assemblies are respectively connected with strip-shaped joint portions to be integrated, and upon pressing said keytop, at least one of said plurality of switch operating assemblies is pressed, and thereby at least one of said plurality of switch elements can be switched on.

According to a second embodiment, the plurality of switch operating assemblies are integrally configured by stamping an operation member made from a piece of metal plate having a circular external configuration and flexibility and have a plurality of first switch operating assemblies located nearer the circumference to be adjacent to one another at predetermined intervals. The plurality of first switch operating assemblies is adjacent to one another and is connected with said joint portions.

According to a third embodiment, the membrane switch is provided with a first and second switch element insulated from each other on the side said that faces the first switch operating assemblies.

According to a fourth embodiment, the operation member is provided with a second switch operating assembly formed in the circular and approximately center portion thereof so as to be connected with the first switch operating assemblies. The membrane switch is provided with third switch elements capable of being switched on by an operation of said second switch operation assembly on the side facing said second switch operation assembly.

According to a fifth embodiment, the membrane switch has an upper and lower sheet configured to face each other by folding back a piece of sheet member. The upper and lower sheets hold a spacer of a predetermined thickness disposed therebetween. The first to third switch elements include an upper and lower electrode formed on the sides where said upper and lower sheets are facing each other. The spacer is provided with holes of a predetermined size formed at the positions corresponding to the positions where said upper and lower electrodes that face each other are formed.

According to a sixth embodiment, the plurality of first switch operating assemblies have such a configuration that the circumferential portion is in contact with said upper sheet and the inner circumferential portion floats over the upper sheet by a predetermined margin.

According to a seventh embodiment, the first switch operating assembly is provided with a first contact pressing portion, the first switch element can be pressed by said first contact pressing portion to be switched on, the domed apex of said first switch operating assembly is reversely pressed, and the second switch element thereby can be switched on.

According to an eighth embodiment, the first operating assemblies are formed at eight places in the circumference of said operation member at intervals of approximately 45 degrees with respect to the second switch operating assembly in the circumferential direction. The first switch elements and second switch elements are respectively formed in said eight first switch operating assemblies and the membrane switch facing the assemblies 6.

According to a ninth embodiment, at least one of the second switch elements can be prevented from being switched on by said spacer.

According to a tenth embodiment, the operation member is provided with bar portions formed around the second switch operating assembly to be connected with the joint portions and thereby integrated with the operation member. The bar portion is provided with fixing portions capable of fixing said operation member to the reverse side of the keytop. The fixing portions combine the keytop and the operation member.

According to a eleventh embodiment, the keytop is provided with a first convex portion formed on the reverse side thereof at the position facing the domed apex of the first switch operating assembly, and a second convex portion formed on the same side at the position facing the domed apex of the second switch operating assembly. The second convex portion presses the first switch operating assembly by a first operation of lightly pressing the circumferential part of the keytop, and the first switch element is thereby switched on by the first contact pressing portion. The apex of the first switch operating assembly is reversely pressed by a second operation of strongly pressing the circumferential part of the keytop, and the second switch element is thereby switched on.

According to a twelfth embodiment, the first convex portion located at a position that faces the apex of the first switch operating assembly is formed lower than the second convex portion. In the initial state before pressing the keytop there is a clearance of a predetermined dimensions formed between the first convex portion and the apex of the first switch operating assembly.

According to a thirteenth embodiment, the multidirectional input device includes a stationary plate on which the membrane switch can be placed. A ringed holder member is provided on the membrane switch that is placed on said stationary plate and is capable of fixing the circumference of the operation member integrated with the keytop to the stationary plate. The holder member has a configuration such that the operating surface of the keytop can be exposed in the ringed inside portion of the holder member.

A plurality of switch operating assemblies of a multidirectional input device is respectively connected with strip-shaped joint portions to be integrated. Upon pressing said keytop, at least one of said plurality of switch operating assemblies is pressed, and thereby at least one of said plurality of switch elements can be switched on. Some of a plurality of switch elements that are formed on the same surface can be simultaneously switched on, so that it is possible to scroll a plurality of menus.

The plurality of switch operating assemblies are integrally configured by stamping an operation member made from a piece of metal plate that has a circular external configuration and flexibility and have a plurality of first switch operating assemblies located nearer the circumference to be adjacent to one another at predetermined intervals. The plurality of first switch operating assemblies is adjacent to one another are connected with said joint portions. A piece of metal plate is stamped by, for example, pressing, so that it is possible to form an operation member with facility in machining and high precision.

The membrane switch is provided with a first and second switch element insulated from each other on the side facing said first switch operating assemblies. One first switch operating assembly can switch on two circuits, so that high operational feeling can be realized.

The operation member is provided with a second switch operating assembly formed in the circular and approximately center portion thereof so as to be connected with the first switch operating assemblies. The membrane switch is provided with third switch elements capable of being switched on by an operation of said second switch operation assembly on the side facing said second switch operation assembly. It is possible to input a "decision" command or the like, so that further multi-functionality can be realized.

The membrane switch has an upper and lower sheet configured to face each other by folding back a piece of sheet member. The upper and lower sheets hold a spacer of a predetermined thickness disposed therebetween. The first to third switch elements include an upper and lower electrode formed on the sides where said upper and lower sheets face each other. The spacer is provided with holes of a predetermined size formed at the positions that correspond to the positions where said upper and lower electrodes face each other are formed. A membrane switch comprising fewer components can be realized.

The plurality of first switch operating assemblies have such a configuration that the circumferential portion is in contact with said upper sheet and the inner-circumferential portion floats over the upper sheet by a predetermined margin. In an initial state where the keytop stays up, the first switch element is not likely to be mistakenly switched on.

The first operating assemblies are formed at eight places in the circumference of said operation member at intervals of approximately 45 degrees with respect to the second switch operating assembly in the circumferential direction. The first switch elements and second switch elements are formed in said eight first switch operating assemblies and the membrane switch faces the assemblies. It is possible to provide a small-sized multidirectional input device allowing input in eight directions.

At least one of the second switch elements can be prevented from being switched on by said spacer. It is possible to provide a multidirectional input device that may be configured with different input ways and thus rich in variety of input.

The operation member is provided with bar portions formed around the second switch operating assembly to be connected with the joint portions and thereby integrated with the operation member. The bar portion is provided with fixing portions capable of fixing said operation member to the reverse side of the keytop. The fixing portions combine the keytop and the operation member. Therefore, the facility of assembly can be realized.

The keytop is provided with a first convex portion formed on the reverse side thereof at the position facing the domed apex of the first switch operating assembly and a second convex portion formed on the same side at the position facing the domed apex of the second switch operating assembly. The second convex portion presses the first switch operating assembly by a first operation of lightly pressing the circumferential part of the keytop. The first switch element is thereby switched on by the first contact pressing portion. The apex of the first switch operating assembly is reversely pressed by a second operation of strongly pressing the circumferential part of the keytop. The second switch element is thereby switched on. It is possible to input several commands by changing the pressing force in pressing the keytop, and to thereby increase the variety of operation.

The first convex portion located at a position that faces the apex of the first switch operating assembly is formed lower than the second convex portion. In the initial state before pressing the keytop there is a clearance of predetermined dimensions formed between the first convex portion and the apex of the first switch operating assembly. Therefore, in an initial state, the first and second switch elements are not likely to be mistakenly switched on.

The multidirectional input device includes a stationary plate on which the membrane switch can be placed. A ringed holder member is provided on the membrane switch placed on the stationary plate and capable of fixing the circumference of the operation member integrated with the keytop to the stationary plate. The holder member has a configuration such that the operating surface of the keytop can be exposed in the ringed inside portion of the holder member. Therefore, it is possible to provide a multidirectional input device having fewer components, facility of assembly and high operability.

DRAWINGS

DESCRIPTION

The multidirectional input device 1 includes a stationary plate 2 that is made of a metal plate with a predetermined thickness and allocated at the lowermost part of the device. The stationary plate 2 includes the circular membrane placing section 2*a*, and through the circumferential part of the circular membrane placing section 2*a* there are the fixing holes 2*b* formed to be capable of fixing the holder member 17 described later. The stationary plate 2 includes fixing arm portions 2*c* formed to be protruded from the membrane placing section 2*a* in the four directions.

Figure 1:
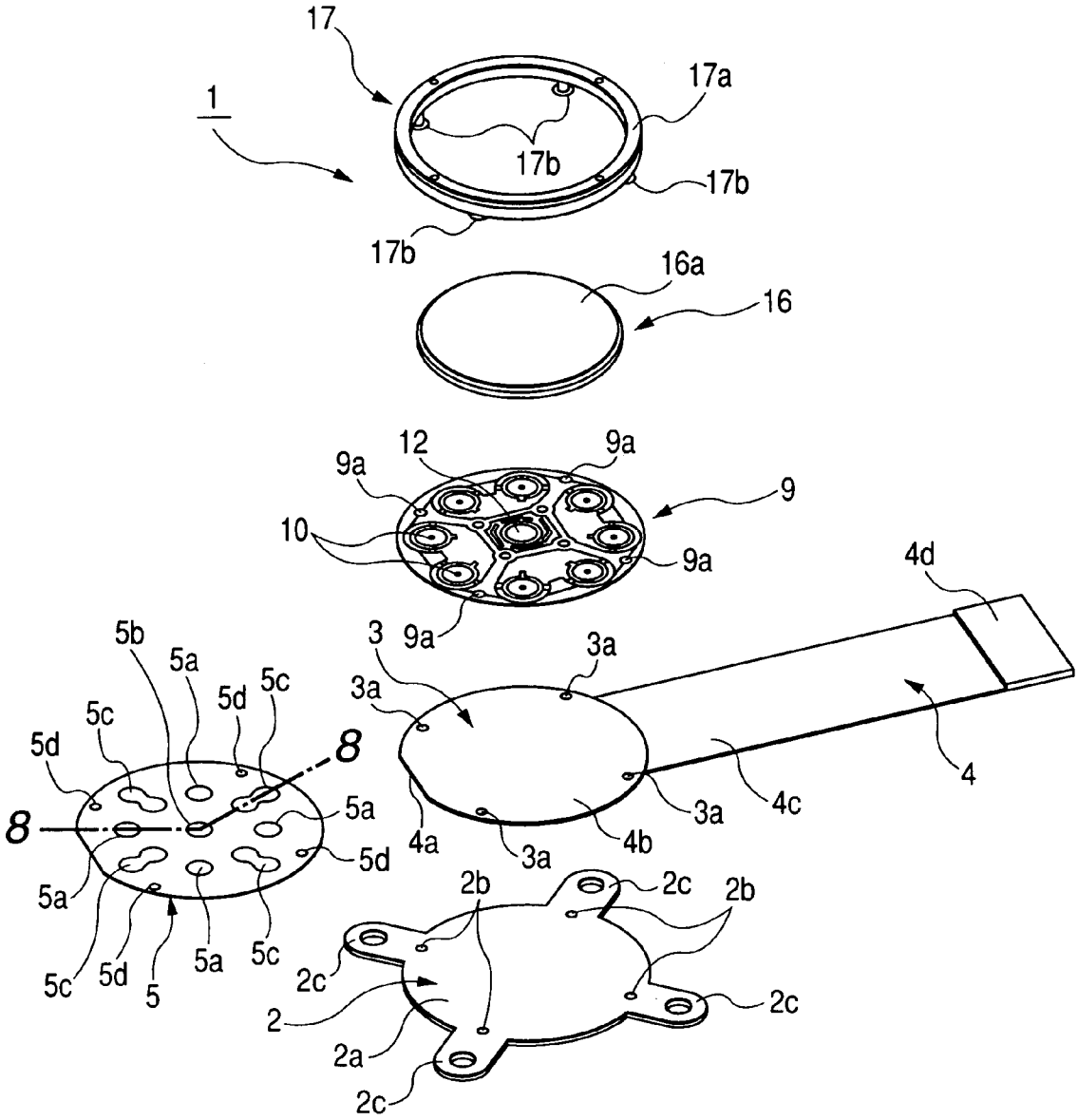
FIG. 1 is an exploded perspective view that illustrates a multidirectional input device.
Figure 2:
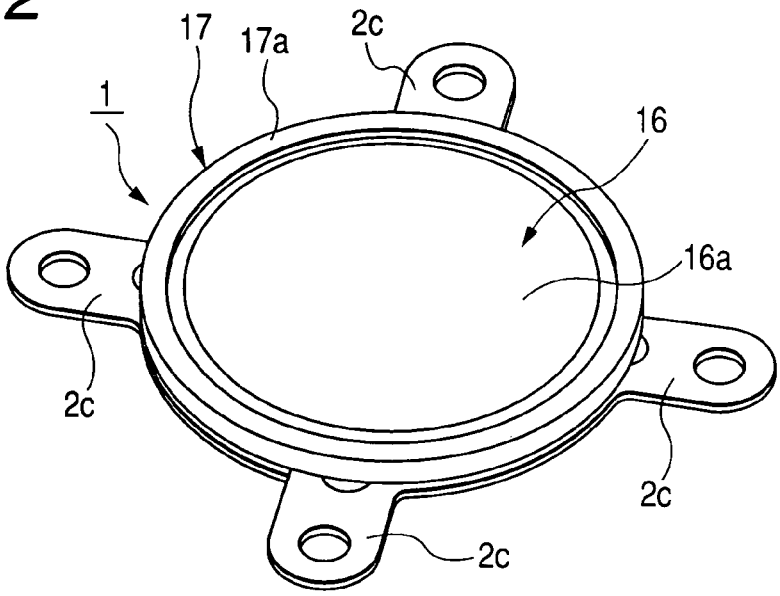
FIG. 2 is a perspective view that illustrates a multidirectional input device.
Figure 3:
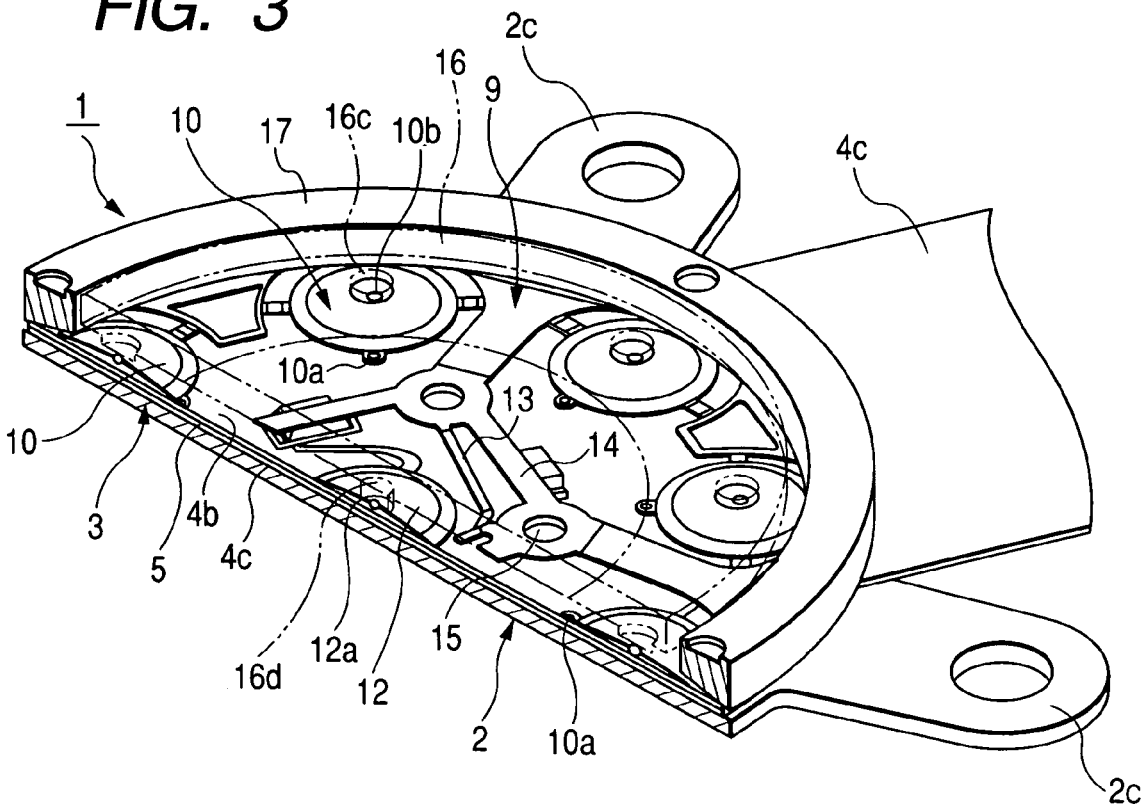
FIG. 3 is a cross-sectional view of part of the multidirectional input device.

The membrane switch 3 is placed on the membrane placing section 2*a* of the stationary plate 2. The membrane switch 3 is constituted by the approximately round upper sheet 4*b* capable of being placed on the membrane placing section 2*a* and the lower sheet 4*c* formed by folding back the piece of sheet member 4 made of a resin film at the foldback portion 4*a* as shown in FIG. 3. The terminal portion 4*d* is drawn from the lower sheet 4*c* so as to be connected to an external electronic apparatus or the like (not shown).

The spacer 5 of a predetermined thickness is held between the upper and lower sheets 4*b* and 4*c*. The spacer 5 is provided with the four first through-holes 5*a* of a predetermined size formed in the circumference having the diameter C shown in FIG. 4 at even intervals of approximately 90 degrees, and with the second through-hole 5*b* formed in the center of the spacer.

The four third through-holes 5*c*, which are made of two holes partially overlapped in a gourd shape, are formed between respective four first through-holes 5*a* at even intervals. The inner holes of the four third through-holes 5*c* are formed to be located along the circumference of a circle connecting the respective four first through-holes 5*a*. In such a state that the spacer 5 thus constructed is being held between the upper and lower sheets 4*b* and 4*c*, the first switch elements are formed on the circumference of a circle of the same diameter connecting the first through-holes 5*a* and the inner circles of the gourd-shaped third through-holes 5*c*. The upper and lower electrodes 6*a* and 6*b* are formed, for example, by printing, in the upper and lower sheets 4*b* and 4*c* corresponding to the positions of the first switch elements.

Figure 4:
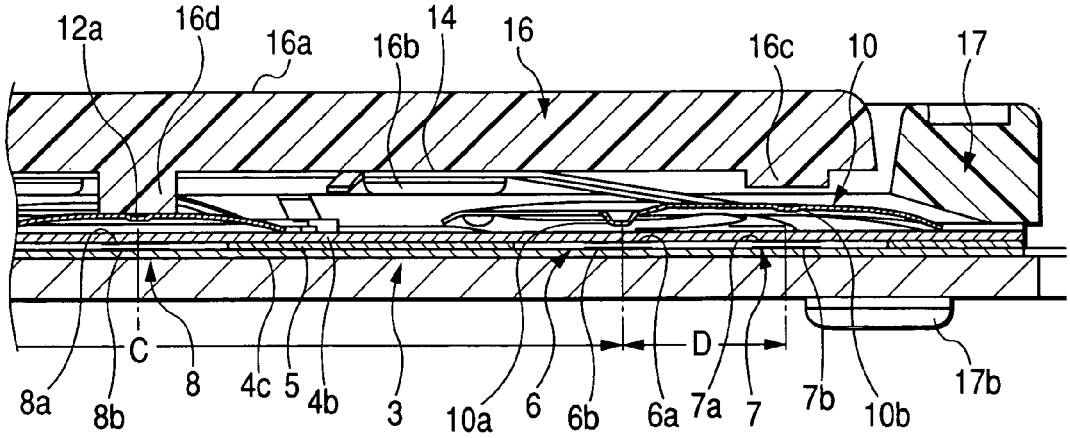
FIG. 4 is a cross-sectional view of a part that explains the operation of the first switch operating assembly.

As shown in FIG. 4, the second switch elements 7 are formed in the outer side at a distance of D from the first switch elements 6. The upper and lower electrodes 7*a* and 7*b* are formed, for example, by printing in the upper and lower sheets 4*b* and 4*c* corresponding to the positions of the second switch elements 7.

The third switch element 8 is formed in the upper and lower sheets 4*b* and 4*c* that corresponds to the position of the second through-hole 5*b* in the center of the spacer 5. The upper and lower electrodes 8*a* and 8*b* are formed at the positions corresponding to the third switch element 8 in the upper and lower sheets 4*b* and 4*c*.

The first and second switch elements 6 and 7 are formed at eight positions located at intervals of approximately 45 degrees where the first through-holes 5*a* and third through-holes 5*c* of the spacer 5 are formed. The respective upper electrodes 6*a*, 7*a* and 8*a*, and the respective lower electrodes 6*b*, 7*b* and 8*b* are insulated from each other by a clearance of predetermined dimensions formed with the spacer 5. By the pressing of the first and second switch operating assemblies 10 and 12 described later, the upper electrodes 6*a*, 7*a* and 8*a*, and the lower electrodes 6*b*, 7*b* and 8*b* can be brought into conduction, allowing input of the switches.

At the positions where circular first through-holes 5*a* are formed, only the first switch elements 6 are disposed. The second switch elements 7 located in the vicinity of the first through-holes 5*a* hold the spacer 5 therebetween, whereby the upper and lower electrodes 7*a* and 7*b* are insulated from each other. The fixing holes 3*a* and 5*d*, into which the fixing legs 17*b* of the holder member 17 described later can be inserted, are formed in the circumferential part of the membrane switch 3 and spacer 5.

The operation member 9 made of a piece of metal plate with flexibility is formed in a circular external configuration roughly same in size as the upper sheet 4*b* of the membrane switch 3, and is allocated on the membrane switch 3.

Figure 7:
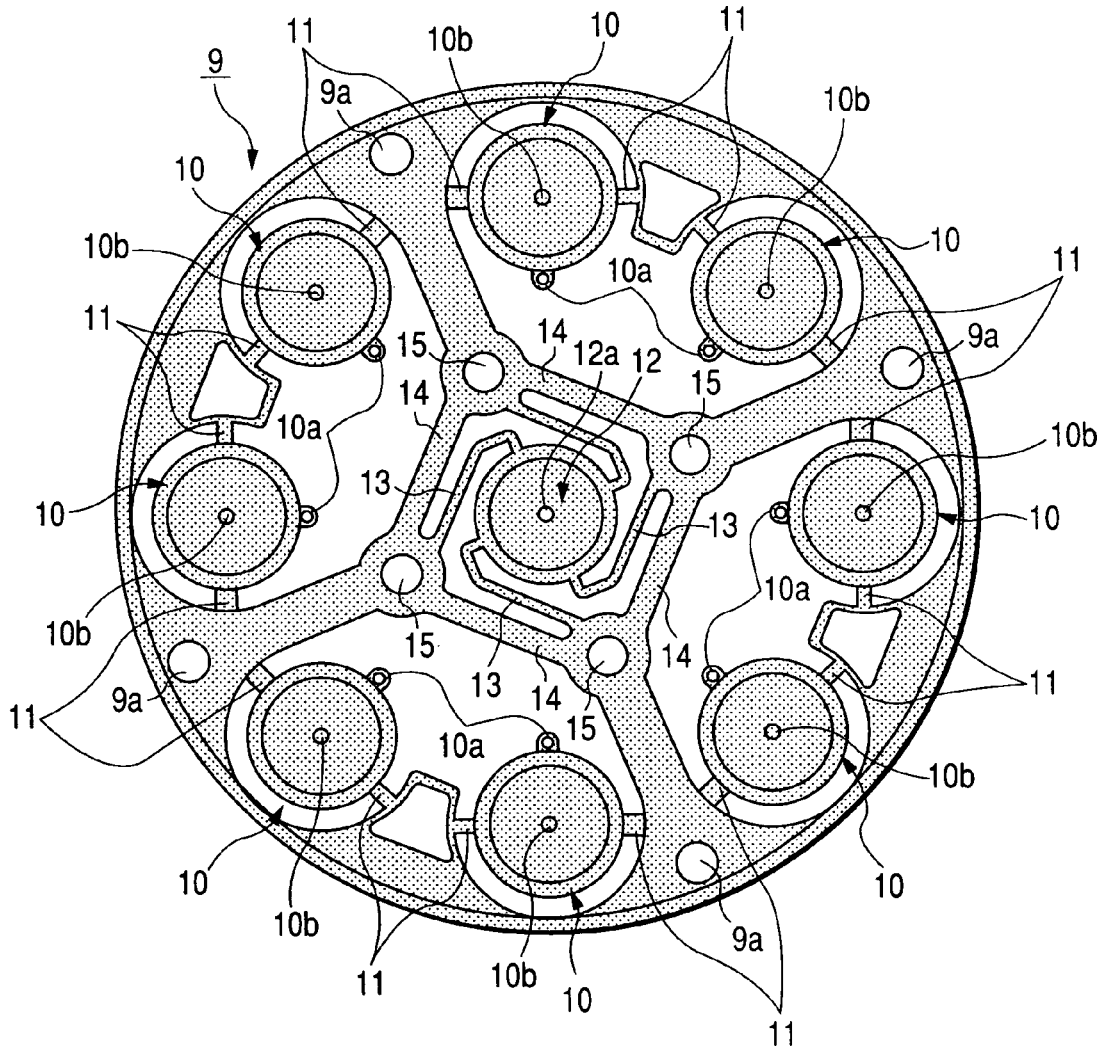
FIG. 7 is a plan view of the operation member.
Figure 8:
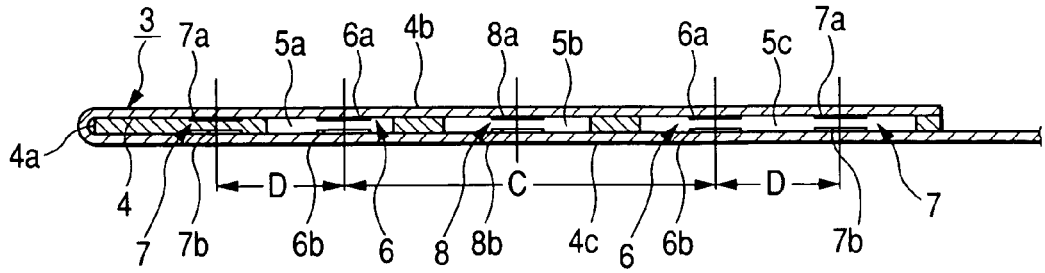
FIG. 8 is a cross-sectional view of the membrane switch of FIG. 1 taken along the line 8-8.
Figure 9:
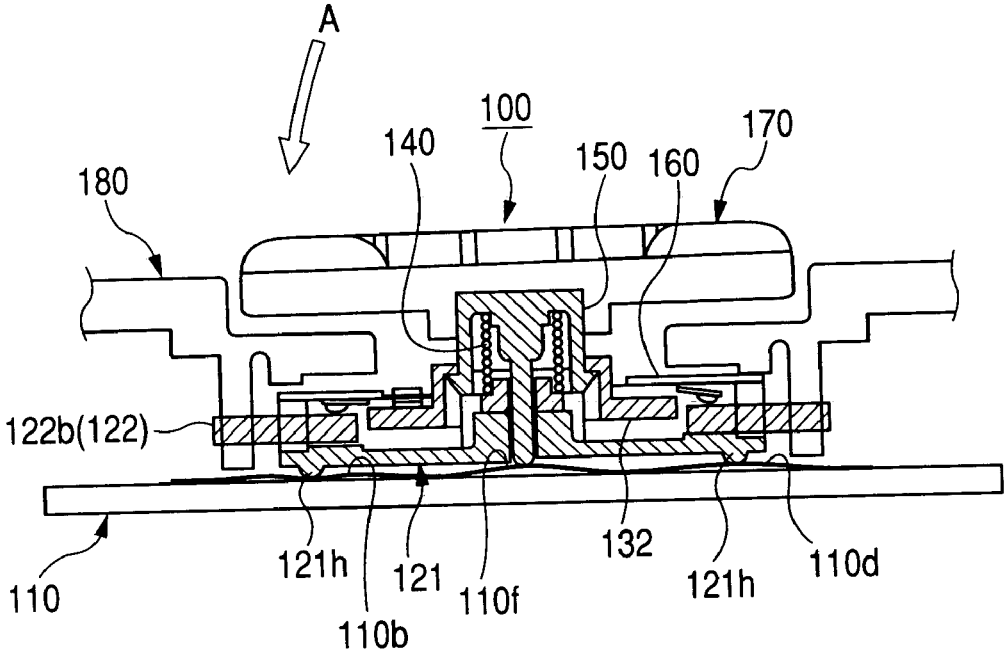
FIG. 9 PRIOR ART
FIG. 9 is a cross-sectional view of a part of a conventional multidirectional input device.
Figure 10:
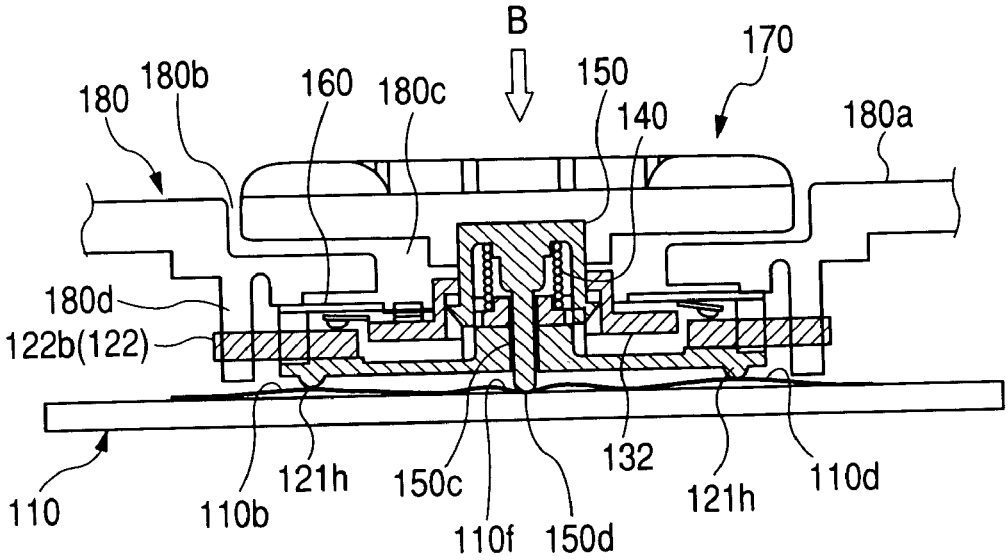
FIG. 10 PRIOR ART
FIG. 10 is a cross-sectional view of a part of a conventional multidirectional input device.

As shown in FIG. 7, the operation member 9 is partially stamped, for example, by pressing, and is provided with the plurality (eight) of first operating assemblies 10 formed nearer the circumference of said operation member at intervals of approximately 45 degrees as being adjacent to each other.

The plurality of first operating assemblies 10 are formed in a circular shape and are provided with the first contact pressing portions 10*a* formed to be slightly protruded in an arc shape to the inner circumferential side shown in FIG. 7. By the pressing of the first contact pressing portion 10*a*, the upper electrode 6*a* and the lower electrode 6*b* can be brought into conduction, allowing input of the switches.

The plurality of first switch operating assemblies 10 adjacent to each other are connected with the strip-shaped first joint portions 11 to be integrated. The one second switch operating assembly 12 is connected with, for example, four strip-shaped and sinistral second joint portions 13, and formed in the circular and approximately center part of the operation member 9. In the second switch operating assembly 12, the domed apex portion 2*a* is formed. Upon this apex portion 12*a* being pressed by the keytop 16 described later, the first switch operating member 12 is reversely pressed, thereby switching on the third switch element 8 of the membrane switch 3.

The second switch operating assembly 12 is surrounded by the wide bar portions 14. The second switch operating assembly 12 is connected with the bar portions 14 through the second joint portions 13, and the fixing holes 15 are formed at four places of the bar portions 14 as through-holes. Through the circumferential part of the operation member 9 there are four fixing holes 9*a* formed to be capable of fixing the holder member 17 described later. The keytop 16 made of a resin member smaller than the external dimensions of the circular operation member 9 is allocated on the operation member 9. The keytop 16 is formed in a circular shape having a diameter of approximately 18 mm, provided with the operating surface 16*a* formed on the surface thereof, and configured such that, for example, an operator can perform an operation by pressing and simultaneously sliding his/her finger or the like.

The four fixing convex portions 16*b* are formed at the positions facing the four fixing holes 15 of the operation member 9 in the reverse side of the keytop 16. The fixing convex portion 16*b* is fitted in the fixing hole 15 of the operation member 9, and by thermal caulking or the like to the fixing convex portion 16*b*, the operation member 9 and keytop 16 are combined.

As shown in FIG. 4, the first pressing convex portions 16*c* are formed at the positions that face the domed apex portions 10*b* of the first switch operating assemblies 10 on the reverse side of the keytop 16. The second pressing convex portion 16*d* are formed at the position that face the domed apex portion 12*a* of the second switch operating assembly 12, and the first pressing convex portion 16*cl* is formed lower than the second pressing convex portion 16*d*.

In the initial state before pressing the keytop 16, the second pressing convex portion 16*d* formed in the center portion of the reverse side of the keytop 16 rises at a predetermined height due to the elasticity applied by the domed apex portion 12*a* of the second switch operating assembly 12, whereby there is a clearance of predetermined dimensions formed between the first pressing convex portion 16*c* and the apex portion 10*b* of the first switch operating assembly 10.

The ringed holder member 17 made of resin material is allocated around the circumference of the operation member 9. The fixing legs 17*b* are formed to be protruded from the four points on the reverse side of the ring portion 17*a* of the holder member 17. The fixing legs 17*b* are fitted into the fixing holes 9*a* of the operation member 9, fixing holes 3*a* of the membrane switch 3 and fixing holes 2*b* of the stationary plate 2, and then the front end of the fixing leg 17*b* protruding from the stationary plate 2 is subject to thermal caulking, whereby the multidirectional input device 1 according to the present invention is configured.

The operating surface 16*a* of the keytop 16 is exposed from the inner circumferential portion of the ring portion 17*a*. An operator can perform a desired input by pressing and simultaneously sliding his/her finger or the like on the operating surface 16*a* in a desired direction.

With the operating method of the multidirectional input device 1 as shown in FIG. 4, before pressing the keytop 16, the second convex portion 16*d* of the keytop 16 abuts against the apex of the second switch operating assembly 12, and the operating surface 16*a* of the keytop 16 is exposed from the inner circumferential portion of the ring portion 17*a* of the holder member 17 due to the elastic force of the second switch operating assembly 12.

Figure 5:
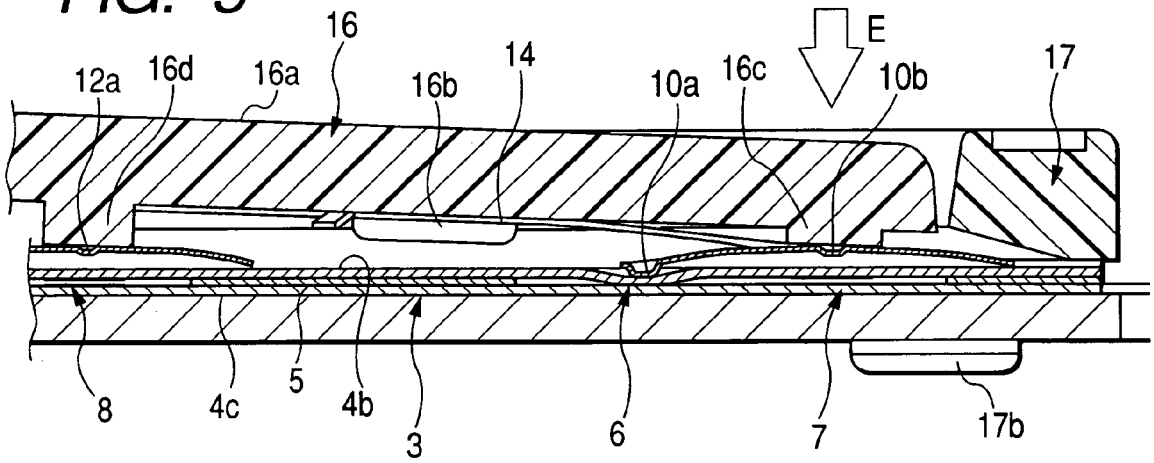
FIG. 5 is a cross-sectional view of a part that explains the operation of the first switch operating assembly.
Figure 6:
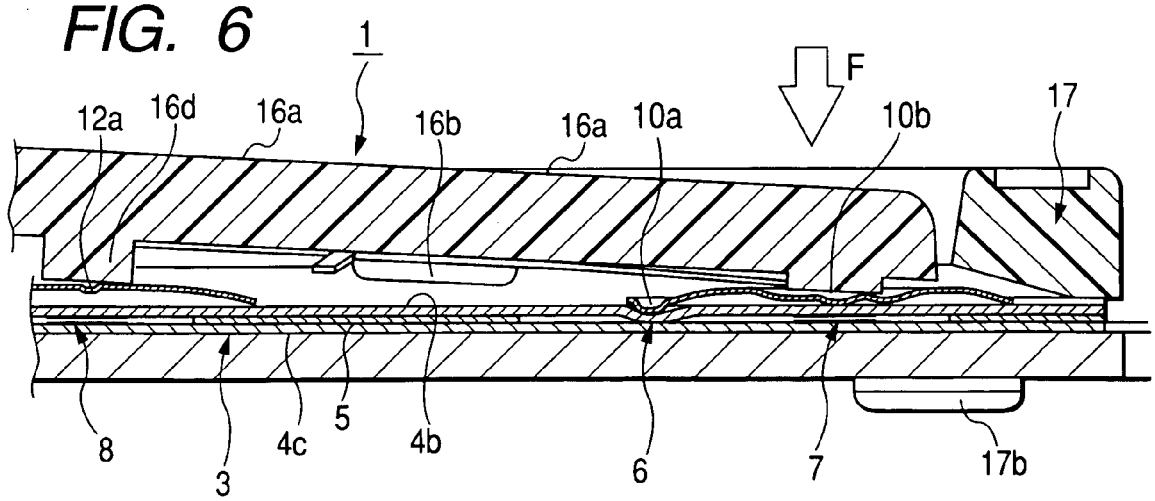
FIG. 6 is a cross-sectional view of a part that explains the operation of the first switch operating assembly.

By a first operation of lightly pressing part of the circumference of the keytop 16 in the initial state shown in FIG. 4 in the direction of the arrow E as shown in FIG. 5. The first convex portion 16*c* lightly presses the apex portion 10*b* of the first switch operating assembly 10. The first contact pressing portion 10*a* of the first switch operating assembly 10, which is somewhat apart from the upper sheet 4*b* is pressed as shown in FIG. 4. The upper electrode 6*a* formed in the upper sheet 4*b* is thereby moved down, with the result that the first switch element 6 is switched on.

By a second operation of strongly pressing the circumferential part of the keytop 16 in the direction of the arrow F, the apex portion 10*b* of the first switch operating assembly 10 is reversely pressed, whereby the second switch element 7 is switched on. The first switch element 6 is in a state of being switched on.

With the foregoing multidirectional input device 1, the plurality of first and second switch elements 6 and 7 are formed in the circumferential part of the membrane switch 3 at predetermined intervals. Since the first and second switch elements 6 and 7 are switched on in turn, it is possible to detect the operational direction, operating speed and so on of the keytop 16.

Although the four second switch elements 7 nearer the circumference can be switched on, the eight first switch elements 6 in the inner circumferential can be all switched on. Any kind of scrolling or pointing operation can be performed on a display, so that it is possible to easily perform a menu selection or the like, for example, on an LCD screen of a variety of electronic devices by a finger or the like laid on the operating surface 16*a* of the keytop 16.

It is possible to decide by pressing the center portion of the keytop 16 and switching on the third switch element 8. For example, upon pressing the keytop 16, at least one of the plurality of the first and second switch operating assemblies 10 and 12 is pressed, whereby at least any one of the plurality of first and second switch elements 6, 7 and 8 can be switched on.

Although the membrane switch 3, operation member 9, keytop 16 and holder member 17 were explained as a circular shape in the embodiment of the present invention, the shape of them may be, for example, a rectangular shape. Although the size of the keytop 16 was explained as a size smaller than the external dimensions of the operation member 9 in the embodiment of the present invention, the size of the keytop 16 may be larger than that of the operation member 9.

The invention claimed is:

1. A multidirectional input device comprising:

a keytop capable of moving up and down through pressing;

a membrane switch that has a plurality of switch elements arranged on a side that faces the reverse side of said keytop; and a plurality of first switch operating assemblies arranged above the plurality of switch elements, wherein the plurality of first switch operating assemblies is capable of switching on the switching elements, and upon pressing said keytop, at least one of the plurality of first switch operating assemblies is pressed, and thereby at least one of the plurality of switch elements can be switched on, wherein the plurality of first switch operating assemblies are embodied in an operation member comprising a metal plate that has a circular external configuration and flexibility, and the plurality of first switch operating assemblies are located near the circumference to be adjacent to one another at predetermined intervals, and the first switch operating assemblies adjacent to one another are connected with joint portions.

2. The multidirectional input device according to claim 1, wherein the membrane switch is provided with a first and second switch element insulated from each other on the side that faces the plurality of first switch operating assemblies.

3. The multidirectional input device according to claim 2, wherein the operation member is provided with a second switch operating assembly formed in the circular and approximately center portion thereof and is connected with the first switch operating assemblies, and the membrane switch is provided with third switch elements that are capable of being switched on by an operation of said second switch operating assembly on the side that face the second switch operation assembly.

4. The multidirectional input device according to claim 3, wherein the membrane switch has an upper and lower sheet configured to face each other by folding back a piece of sheet member, wherein the upper and lower sheets hold a spacer of a predetermined thickness disposed therebetween, wherein the first to third switch elements include an upper and lower electrode formed on the sides where said upper and lower sheets are facing each other, and wherein the spacer is provided with holes of a predetermined size formed at the positions that correspond to the positions where said upper and lower electrodes that face each other are formed.

5. The multidirectional input device according to claim 4, wherein the plurality of first switch operating assemblies have a circumferential portion that is in contact with the upper sheet and wherein the inner circumferential portion floats over the upper sheet by a predetermined margin.

6. The multidirectional input device according to claim 5, wherein the first switch operating assembly is provided with a first contact pressing portion, wherein the first switch element can be pressed by said first contact pressing portion to be switched on, wherein a domed apex of said first switch operating assembly is reversely pressed, and wherein the second switch element thereby can be switched on.

7. The multidirectional input device according to claim 4, wherein at feast one of the second switch elements is prevented from being switched on by said spacer.

8. The multidirectional input device according to claim 3, wherein the first switch operating assemblies are formed at eight places in the circumference of said operation member at intervals of approximately 45 degrees with respect to the second switch operating assembly in the circumferential direction, and wherein the first switch elements and second switch elements are respectively formed in said eight first switch operating assemblies and the membrane switch that face the assemblies.

9. The multidirectional input device according to claim 3, wherein the operation member is provided with bar portions formed around the second switch operating assembly that are connected with the joint portions and thereby integrated with the operation member, the bar portion is provided with fixing portions capable of fixing said operation member to the reverse side of the keytop, and the fixing portions combine the keytop and the operation member.

10. The multidirectional input device according to claim 2, wherein the first switch operating assembly is provided with a first contact pressing portion, wherein the first switch element can be pressed by said first contact pressing portion to be switched on, wherein a domed apex of said first switch operating assembly is reversely pressed, and wherein the second switch element thereby can be switched on.

11. The multidirectional input device according to claim 10, wherein the keytop is provided with a first convex portion formed on the reverse side thereof at the position facing the domed apex of the first switch operating assembly and a second convex portion formed on the same side at the position facing a domed apex of a second switch operating assembly, the second convex portion presses the first switch operating assembly by a first operation of lightly pressing the circumferential part of the keytop, and the first switch element is thereby switched on by the first contact pressing portion, and an apex of the first switch operating assembly is reversely pressed by a second operation of strongly pressing the circumferential part of the keytop, and the second switch element is thereby switched on.

12. The multidirectional input device according to claim 11, wherein the first convex portion located at a position that faces the apex of the first switch operating assembly is formed lower than the second convex portion, and wherein in the initial state, before pressing the keytop, there is a clearance of predetermined dimensions formed between the first convex portion and the apex of the first switch operating assembly.

13. The multidirectional input device according to claim 1, further comprising:

a stationary plate on which the membrane switch can be placed; and a ringed holder member provided on the membrane switch placed on said stationary plate and capable of fixing the circumference of the operation member integrated with the keytop to the stationary plate, wherein the holder member has a configuration such that the operating surface of the keytop is exposed in the ringed inside portion of the holder member.

* * * * *

UNITED STATES PATENT AND TRADEMARK OFFICE

CERTIFICATE OF CORRECTION

PATENT NO. : 7,288,732 B2
APPLICATION NO. : 11/479752
DATED : October 30, 2007
INVENTOR(S) : Junji Hashida It is certified that error appears in the above-identified patent and that said Letters Patent is hereby corrected as shown below:

In the Claims

Column 9, line 50, in claim 7, line 2, after "wherein at" delete "feast" and substitute --least-- in its place.

Signed and Sealed this

Thirteenth Day of May, 2008

JON W. DUDAS
*Director of the United States Patent and Trademark Office*